United States Patent [19]

Knight

[11] 4,050,961

[45] Sept. 27, 1977

[54] METHOD FOR CASTING ANODES

[76] Inventor: Bill J. Knight, 7315 S. Settler Ave., Tucson, Ariz. 85706

[21] Appl. No.: 526,161

[22] Filed: Nov. 22, 1974

[51] Int. Cl.[2] ..... B22D 25/04; B22D 35/04

[52] U.S. Cl. ..... 148/32; 75/166 R; 164/128; 164/135; 164/335; 141/236

[58] Field of Search ..... 164/122, 128, 135, 335–337, 164/348; 141/236; 148/32; 75/166 R

[56] References Cited

U.S. PATENT DOCUMENTS

| | | | |
|---|---|---|---|
| 547,009 | 10/1895 | Hampton | 164/135 X |
| 1,354,732 | 10/1920 | Disinger | 164/335 X |
| 1,498,971 | 6/1924 | Ladd | 164/128 X |
| 1,909,773 | 5/1933 | Lewin | 164/128 X |
| 2,135,245 | 11/1938 | Yerkey | 164/335 X |
| 3,659,644 | 5/1972 | DeBie | 164/128 X |
| 3,863,703 | 2/1975 | Nishimura | 164/348 X |

*Primary Examiner*—Robert D. Baldwin

*Attorney, Agent, or Firm*—Fitch, Even, Tabin & Luedeka

[57] ABSTRACT

A method for casting an insoluble anode for use in the electrowinning of copper, the anode being formed by casting molten lead alloy preferably including calcium as an alloying agent in a suitable mold, necessary flow of the molten alloy being minimized within the mold, the temperature of the molten alloy and the temperature of the mold being selected to minimize the time necessary for solidification of the molten alloy within the mold, the lead alloy anode preferably being removed from the mold substantially as soon as it is mechanically self-supporting and rapidly cooling the anode in an unstressed configuration to freeze its grain structure and develop dimensional stability. The present invention also relates to a lead alloy casting produced by the above method as well as to an insoluble anode formed from a lead alloy including calcium as an alloying agent, the anode being characterized by the uniform precipitate distribution illustrated in FIG. 7 and the surface finish illustrated in FIG. 9.

23 Claims, 9 Drawing Figures

METHOD FOR CASTING ANODES

BACKGROUND OF THE INVENTION

The present invention relates to casting techniques and apparatus. More particularly, the invention is directed towards techniques and apparatus for forming anodes, preferably from lead alloys, as well as anodes formed thereby.

The techniques described below in connection with the present invention are particularly contemplated in connection with relatively large anodes of a type employed as an insoluble anode in the electrowinning of copper. Accordingly, novel features of the present invention are described below in connection with such an electrowinning process. However, it will be apparent that the present invention may also be employed for other purposes, for example, in the casting of non-ferrous materials for use as insoluble anodes as well as in other applications.

The Electrowinning Process

A brief description of the electrowinning process for the recovery of copper is set forth below to permit a better understanding of the present invention. Generally, a solution of concentrated copper in sulfuric acid is formed, usually by leaching of copper ore. An acid concentration in the range of 100–200 gms. per liter of sulfuric acid is generally necessary in order to place sufficient copper in solution. A corresponding copper concentration may be in the range of approximately 30–50 gms. per liter for a pregnant electrolyte to be introduced into the electrowinning process.

The copper-laden solution is then introduced into one or more electrolytic cells each containing a series of anodes and cathodes.

Within the electrolytic cells, the anodes are substantially insoluble with an electrical potential impressed between the anodes and cathodes tending to cause migration of copper from the electrolyte toward the cathode with metallic copper being deposited or built up on each of the cathodes. Fresh electrolyte is constantly supplied to the cells. Sulfuric acid solution is recycled from the cells for the leaching or solution of additional copper which is then again introduced into the electrowinning cells.

The cathodes containing the build-up of metallic copper are periodically removed from the cells and replaced by fresh electrodes or starter sheets to permit continued deposition. The cathodes removed from the cells contain relatively pure copper, for example in the range of 99% purity. A portion of the copper resulting from the electrowinning process is accordingly used directly in copper consuming applications. However, since many applications require copper of even higher purity, it is also common to further refine copper obtained from the electrowinnning process by conventional electro-refining techniques.

Insoluble Anodes Used In Electrowinning

The theoretically insoluble anodes are a particular source of concern within the electrowinning process and have been the object of substantial development efforts throughout the relatively long history of the electrowinning process. Problems arising in connection with the anodes tend to develop because of the infeasibility of providing a completely insoluble anode which is still capable of adequate electrical performance within the cell. It has been commonly found that material from the anode tends to become dissolved in small quantities within the electrolyte with a portion of the dissolved anode material being collected or trapped upon the cathode together with metallic copper.

For some time, insoluble anodes used in the electrowinning of copper have been formed from lead or lead alloys. Relatively limited amounts of lead have been found within the copper deposit on the cathodes. However, in many copper consuming applications, the acceptable limits for lead as an impurity are very low, commonly in the range of 10–20 parts per million. Much of the effort directed toward development of improved anodes has therefor concerned techniques for making lead or lead alloy anodes having high hardness and resistance to corrosion or exfoliation while also maintaining adequate mechanical and dimensional stability in the anodes to permit their continued use in electrowinning cells over substantial periods of time.

In the recent past, the most common lead alloy employed in electrowinning anodes was one containing substantial quantities of antimony, for example, 5–15% Sb by weight. In addition to such binary alloys, ternary and quaternary alloys including lead and antimony have also been commonly employed with the additional alloying agents being selected from a broad group including arsenic, bismuth, tin, cadmium, thallium, tellurium, mercury, cobalt, barium, strontium, selenium, tantalum, smooth platinum, etc. More recently, lead-silver alloys have been investigated, particularly those in ternary form including a third alloy such as arsenic or bismuth.

Generally, anodes formed from lead alone do not have sufficient hardness or resistance to corrosion or exfoliation to permit their use in electrowinning because of excessive lead migration with the lead being deposited or entrapped upon the cathodes together with metallic copper. The various alloying agents tend to increase hardness and corrosion resistance while also contributing to mechanical and dimensional stability, all of these being particularly desirable characteristics for insoluble anodes in the electrowinning process.

Calcium is an additional material of particular interest within such lead alloys. Although calcium may be employed within binary, ternary or even quaternary alloys in widely varying amounts, the most useful concentrations for calcium in such alloys are believed to be within the range of 0.01 to 0.1% by weight.

The attractive corrosion resistance and superior mechanical properties of lead alloys which contain calcium have been known for many years as is demonstrated to some degree by the use of calcium alloys in the manufacture of battery grids. However, it is to be particularly noted that manufacturing techniques and operating performance requirements for battery grids are different from the requirements for insoluble anodes such as are employed in the electrowinning process. Experience in the battery field may be taken to reinforce the conclusion that lead-calcium alloys are more difficult to cast or otherwise form into a usable configuration.

It is noted in passing at this point that the present invention provides one or more casting techniques which, either alone or in combination, permit the casting of a lead-calcium anode having greatly superior properties of corrosion resistance and mechanical and dimensional stability, particularly for use in electrowinning processes. However, it is again emphasized that the casting techniques of the present invention are not limited merely to lead-calcium alloys employed in insoluble anodes for use in the copper electrowinning process. On the other hand, because of the particular effectiveness of the present invention for forming such anodes, the preferred embodiment and examples of the present invention, as described below, are directed in large part toward such a combination.

It is also noted at this point that the techniques and apparatus provided by the present invention are also specifically applicable to more complex lead-calcium alloys, for example ternary alloys which include silver or tin, for example, as well as calcium.

It was indicated above that the purpose of employing lead alloys is to improve resistance to corrosion or exfoliation as well as to enhance both dimensional and mechanical stability. These requirements are relatively complex for insoluble anodes of the type employed within the electrowinning process. To provide additional background in this connection, it is noted that the "insoluble" or "inert" anodes are immersed in sulfuric acid solution contained by electrowinning cells. Within the electrolytic process or under generally similar conditions commonly employed to stabilize or precondition the anode surface, lead within the anode tends to react with the sulfuric acid and also with air bubbles generated by electrolysis upon the surface of the anode. Interaction of these materials under electrolytic or similar stabilizing conditions tends to cause formation of a film upon the lead or lead alloy anode. The film principally consists of lead dioxide ($PbO_2$) which acts as a semiconductor, thus enabling electrical conductance through the anode and particularly enhancing its corrosion resistance. Lead oxide (PbO) and lead sulfate ($PbSO_4$) are also present during various stages of the film formation and are characterized as being generally poor conductors.

It is theorized that the phenomenon of initial film formation and subsequent film reformation is important in maintaining the corrosion resistance of the anode. In any event, it has been found that the chemical and physical characteristics of the anode are important factors affecting formation of the abovenoted film and accordingly are important in achieving maximum corrosion resistance of the anode.

Important Characteristics For Insoluble Anodes

In addition, certain chemical and physical characteristics of the anode are also important in determining its mechanical and dimensional stability as was suggested above. These chemical and physical properties of the anode, which may affect corrosion resistance and/or mechanical and dimensional stability are summarized below.

Initially, chemical composition of the anode is of critical importance as suggested by the preceding discussion of the various lead alloys which have been developed. For example, it was clearly indicated above that certain lead alloys, particularly those including calcium as well as other binary, ternary and quaternary alloys, contribute both to the corrosion resistance of the anode as well as its mechanical strength and dimensional stability. It is also believed important to maintain in uncombined form the basic lead component except for the presence of precipitates formed with and between the various alloying agents. For example, in a lead-calcium alloy, a precipitate of lead calcium ($PbCa_3$) is believed to be an important factor contributing to the improved characteristics of anodes formed from such alloys.

In one aspect of the present invention, it is theorized that other compound formations of lead, particularly within the anode, may be undesirable. In this regard, it is particularly believed that the combination of lead with oxygen to form either lead oxide or lead dioxide within the anode may undesirably interfere with subsequent formation of a stabilizing or conditioned film, as noted above.

Uniform precipitate distribution is an additional desirable characteristic to be considered in connection with alloy composition of the type discussed immediately above. Particularly with alloy compositions such as lead-calcium, it is believed that precipitate formation and uniform distribution of the precipitate throughout a matrix of lead contributes particularly to corrosion resistance and the related characteristic of surface hardness.

The characteristics of high density and low porosity are believed to be interconnected and jointly contribute again to the characteristics of corrosion resistance and surface hardness for the anode. These characteristics may also affect in part mechanical and dimensional stability of the anode.

Grain size is another characteristic which is believed to provide an important contribution to both corrosion resistance and mechanical characteristics such as hardness. Generally, it is believed that for a non-ferrous metal such as lead, it is desirable to maintain a relatively large or coarse grain size. Here again, the characteristic of coarse or large grain size is particularly important for the lead matrix in an alloy such as lead-calcium. It is assumed that relatively large or coarse grain size in such an alloy contributes both to film formation, as discussed above, and possibly also to uniform precipitate distribution. This supposition again illustrates that the many characteristics discussed herein are interrelated or interdependent upon each other.

Finally, it is believed desirable to form a surface upon the anode which may be characterized as uniform, continuous or generally smooth. It is believed that the nature of the initial surface formed upon the anode is of substantial importance. It is again theorized that the surface characteristics contribute importantly to proper film formation, as discussed above. Possibly, the combined characteristics of a smooth surface and relatively large grain size tend to promote development of a uniform film upon an anode which importantly minimizes corrosion within the electrolytic bath. It will be noted below that in conjunction with the present invention, anodes formed according to the procedure described below tend to have the appearance of being "rolled" or "galvanized." In any event, the surface characteristics of the anode formed according to the present invention are believed to contribute importantly to its value within an electrowinning process.

In summary, the preceding comments have been directed toward a discussion of basic anode characteristics including good resistance to corrosion or exfoliation, mechanical stability or "strength," dimensional stability and relative hardness, both on the anode surface and within the anode interior. In this connection, it is important to note that as material is eventually lost from the anode, those portions originally within the anode interior then form its surface.

In addition, the preceding discussion emphasized the characteristics of chemical composition, uniform precipitate distribution, high density and low porosity, large or coarse grain size and initial surface characteristics of the anode.

This discussion of anode characteristics is set forth above in some detail in order to emphasize advantages of the present invention. With the exception of chemical composition, the other basic anode characteristics discussed above are believed to be primarily dependent upon the method of casting or forming the anode, either alone or in conjunction with the chemical composition.

OBJECTS OF THE INVENTION

Accordingly, it is a basic object of the present invention to provide a method of casting lead alloys in order to achieve various combinations of the characteristics described above.

In addition, it is another basic object of the invention, either alone or in conjunction with the preceding object, to provide a casting technique which is uniquely capable of achieving an economic production rate for lead alloy anodes of a type employed in electrowinning processes for the recovery of copper.

Yet another basic object of the present invention is to provide a novel and particularly useful insoluble lead alloy anode of a type useful in electrowinning processes for metals such as copper, the anode preferably including calcium as an alloying agent.

It is a more specific and related object of the invention to provide such a lead alloy anode, including calcium as one of the alloying agents, wherein the anode is characterized by maximum density, minimum porosity, uniform precipitate distribution and further by a uniformly smooth and hard anode surface, having particular reference to FIGS. 7–9.

In even further particularity, it is an object to provide such a lead alloy anode having a calcium content within the approximate range of 0.01 to 0.1% by weight.

Within the process for producing an anode of the type described above, a number of process objects or elements have been determined as being of interrelated importance. However, it is believed that not all of these objects must necessarily be employed together in order to produce a novel insoluble anode. These process objects are set forth immediately below.

Initially, it is an object of the present invention to provide a method for producing a insoluble lead alloy anode wherein the time period during which the lead alloy remains molten after being poured into a suitable mold is minimized while still assuring adequate flow of the lead alloy for it to enter into intimate and continuous contact with substantially all internal surfaces of the mold. This object, which is particularly directed toward establishing maximum density and a smooth anode surface, may be achieved by controlling the temperature of the molten lead alloy both in a furnace and ladle as well as cooling the cast anode in a manner described in greater detail below.

Accordingly, it is a related object of the invention to provide a method wherein the temperature of a lead alloy is closely controlled prior to casting in a suitable mold.

A further related object of the invention is to maintain the mold at a predetermined temperature at least prior to pouring of the molten lead alloy into the mold in order to reduce the time necessary for solidification of the lead alloy within the mold.

It is a further object of the present invention to provide a process for casting lead alloy wherein flow of the molten lead alloy within a mold is minimized. Initially, the time necessary to harden the lead alloy within the mold may thereby be further reduced. Additionally, minimum flow of the lead alloy within the mold has been found to assist in development of optimum characteristics of maximum density, minimum porosity and possibly in the establishment of optimum grain size and precipitate distribution throughout the anode.

SUMMARY OF THE INVENTION

In view of the preceding background discussion and detailed analysis of objects, the present invention has been found to be particularly instrumental in developing an insoluble anode of lead alloy including calcium as an alloying agent, the anode being characterized by maximum density, relatively minimum porosity, uniform precipitate distribution and particularly by a surface which is hard and smooth or continuous.

The process for producing a lead alloy anode according to the invention is believed to include a number of novel features or steps which interact within a preferred embodiment of the invention to provide such an anode, particularly a lead alloy anode including calcium at an alloying agent. However, it is again stressed that certain elements or steps of the process are believed to be independently useful to achieve a novel and useful anode structure depending, for example, upon the particular composition of the lead alloy anode as well as other operation conditions which may be subject to change.

Initially, the method of the present invention contemplates limiting the amount of time during which the lead alloy remains in a molten state after being introduced into a suitable mold. This time limit is preferably achieved through selectively controlling the temperature of the molten alloy in a melting pot or furnace and in a ladle prior to introduction to the mold. Additionally, the temperature of the mold is also controlled within selected limits at least upon commencement of pouring the lead alloy into the mold.

This element of the invention, as described above, is believed to contribute to both chemical and physical characteristics of the anode. In addition, it is thereby possible to remove the anode from the mold within a relatively short time, for example within 2 to 3 minutes, in order to facilitate further treatment of the anode and to achieve operating economy within the casting operation.

It is particularly contemplated that the anode be suspended in a vertical condition immediately after being removed from the mold. The vertically suspended anode is then rapidly cooled. This step is believed to "freeze" the grain size and precipitate distribution throughout the anode and particularly adjacent its surfaces while also contributing to dimensional and/or mechanical stability.

An additional element of the casting method of the present invention contemplates limiting the amount of flow for the molten lead alloy within the mold. This is believed to contribute to the achievement maximum density and minimum porosity for the anode while also contributing to the formation of a smooth or continuous surface. Minimum flow of the molten alloy within the mold is achieved by preferably disposing the mold in a vertical position with the top of the mold cavity being completely open to receive molten lead alloy along its length. The molten lead alloy is then "streamed" into the mold along the length of the mold cavity with the amount of lead alloy being introduced into each portion of the mold in proportion to the volume of the mold cavity. In this manner, all portions of the mold tend to be filled in approximately the same amount of time with minimum flow of the alloy being necessary within the mold to achieve complete filling of the mold cavity. The alloy material thereby enters into continuous and intimate contact with all surfaces of the mold cavity. In addition to contributing toward the development of maximum density and minimum porosity, minimum flow in the mold is also believed to contribute toward other chemical and physical features of the finished anode such as, for example, uniform precipitate distribution, particularly adjacent the anode surfaces, as well as the surface finish itself.

It is another particular element of the casting method of the present invention to prevent access of oxygen to the molten lead alloy, particularly for an alloy including calcium as an alloying agent, preferably until the molten lead alloy solidifies within the mold to form an insoluble anode. This step is believed important both to regulate chemical composition of the lead alloy within the finished anode and also to limit the loss of calcium from a lead alloy including calcium an an alloying agent.

Additional elements of the method of the present invention are also directed toward maintaining the calcium content of such a lead alloy, for example by the imposition of an electrical potential, preferably a low DC voltage, upon the molten lead alloy within the furnace or melting pot.

Finally, it is also an element of the method of the present invention to select a lead alloy including calcium as an alloying agent. Calcium may be present within the lead alloy to form a binary alloy or other alloying agents may also be added to provide either a ternary or quarternary alloy, for example, from which an insoluble anode may be produced within the scope of the present invention.

Calcium is particularly selected as a preferred alloying agent within the lead alloy because of its tendency to increase alloy hardness, improve corrosion resistance and enhance mechanical or dimensional strength. The calcium alloying agent may be present in a relatively wide range of 0.01 to 0.1% by weight. It is further noted that calcium is a particularly desirable alloying agent for lead alloy anodes because of its tendency to react with sulfuric acid and produce salts of low solubility. This characteristic is believed to greatly contribute toward the formation of protective, compact or thick films of a type particularly suitable for minimizing corrosion resistance of the anode under electrolytic conditions such as those encountered in a electrowinning process.

Additional objects and advantages of the present invention are made apparent in the following description having reference to the accompanying drawings.

DESCRIPTION OF THE DRAWINGS

The present invention is primarily concerned with a method of casting and the composition of an insoluble anode produced by such a method. However, to facilitate understanding of the invention, casting apparatus of the type employed to produce such an insoluble anode is illustrated in FIG. 1 which is a side view in elevation of apparatus including a mold, a ladle, and a furnace or melting pot.

DESCRIPTION OF THE PREFERRED EMBODIMENT

Figure 1:
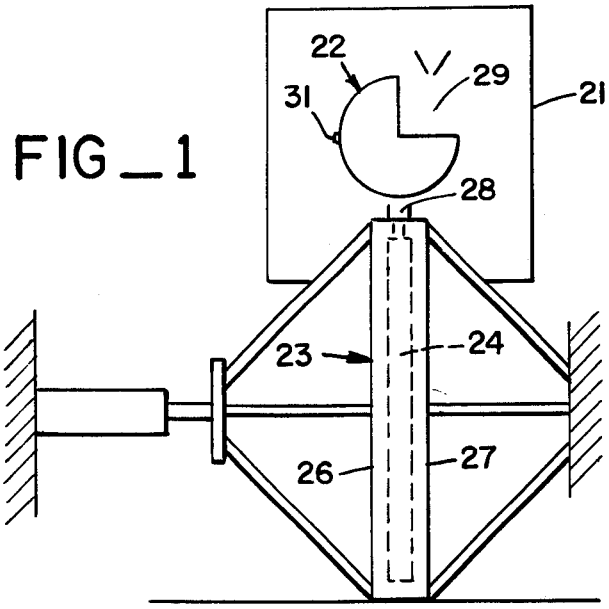

As noted above, the present invention is directed both toward a method of producing or casting an insoluble anode as well as toward an anode produced by the method and having a preferred composition as well as other characteristic features. In view of the relatively large number of features involved for both the insoluble anode and the method of casting it, the following description includes first a discussion of suitable alloys for use in such an insoluble anode followed by a description of the anode configuration, a description of the casting apparatus, a description of the casting process followed by a number of specific examples setting forth various anodes produced by the present method with pertinent method parameters for each example.

Suitable Alloy Compositions

As indicated above, the present invention is particularly directed toward lead alloys including calcium as an alloying agent. However, the invention is not intended to be limited to lead alloys including calcium as a single alloying agent or even to alloys necessarily including calcium. For example, a lead alloy including calcium as an alloying agent might also include one or more other alloying agents such as silver or tin. Accordingly, a lead alloy of the type contemplated by the present invention could be, for example, a binary, ternary or quaternary alloy.

Furthermore, it is generally accepted that lead alloys including calcium as an alloying agent are particularly difficult to form or cast. This even further indicates the value and novelty of the present invention in providing a method for successfully casting such materials. However, the success of the present invention in providing cast lead alloys including calcium also indicates its value in casting other materials particularly other generally similar lead alloys, such as those including, for example, silver or tin, while not necessarily being limited to the additional inclusion of calcium.

Moreover, alloying agents such as calcium have a tendency to evaporate or otherwise be lost from the alloy when it is in molten condition. Accordingly, the composition of the alloy as originally produced may vary from the alloy composition within a finished anode.

Generally, one preferred composition for the lead alloy anode includes calcium as an alloying agent either alone or in combination with other alloying agents. More particularly, it is contemplated that a lead alloy anode with calcium as an alloying agent includes calcium within the proximate range of 0.01 to 0.1% by weight. An even more limited concentration for calcium, within the range of approximately of 0.02 to 0.07% by weight, is believed to be of particular importance.

One typical composition for a lead calcium alloy to be employed within the present method, for example as an alloy ingot, includes approximately 0.04–0.06% by weight calcium, the remainder essentially pure lead except for normal impurities. In view of the tendency for calcium to be lost from the alloy, it is accordingly possible that an alloy ingot to be employed within the present casting method may include calcium in excess of the previously noted range.

As a further example of the application for the method of the present invention, it is also believed applicable to lead-antimony alloys including antimony as an alloying agent within the approximate range of 5–15% by weight. One typical composition for such an alloy is set forth below:

Pure, soft lead 90% by wgt.
Pure, antimony 10% by wgt.
Maximum impurity content: Ag—0.0004% by wgt.
Cu—0.0009% by wgt.
Zn—0.0005% by wgt.
As—0.0003% by wgt.
Fe—0.0002% by wgt.
Bi—0.00014% by wgt.

Many additional alloy compositions may also be employed in conjunction with the method of the present invention. Such alloys may include alloying agents of the type summarized above. It is believed that silver and tin have particular value as alloying agents either alone, in combination with each other, and/or in combination with calcium, for example.

Insoluble Anode Configuration

Figure 3:
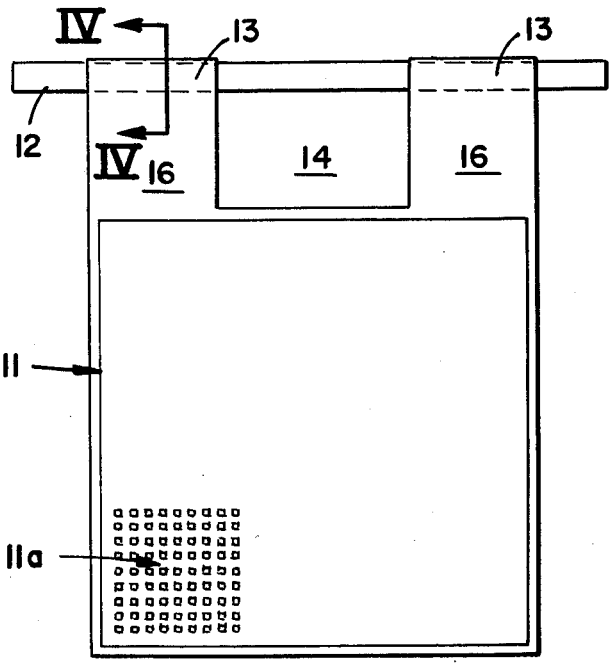
FIG. 3 is a view of an insoluble anode produced by the method of the present invention.

As indicated above, the present invention is particularly directed toward tecnhiques for casting an insoluble anode of a type used in an electrowinning process such as for the recovery of copper. A typical configuration for such an insoluble anode is illustrated in FIG. 3. Referring to FIG. 3, it may be seen that the anode is relatively large, for example having overall dimensions of approximately 48 × 36, a thickness of about one-half inch, with an effective surface area on either side of approximately 8–9 sq. ft. The effective area of the anode is indicated at 11 and includes a generally continuous rectangular portion which is immersed within an electrolyte solution for an electrowinning process. The effective portion 11 of the anode may be either continuous or perforated as illustrated for a portion of the anode at 11*a*. Insoluble anodes are commonly formed with such perforations in order to reduce the weight of the anode and to increase its effective surface.

Figure 4:
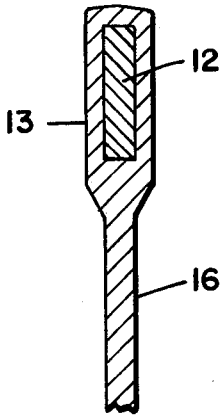
FIG. 4 is a fragmentary view taken along section line IV—IV in FIG. 3.

Each insoluble anode includes a relatively heavy copper bar or conductor 12 which extends transversely beyond the edges of the anode. The extended ends of the copper bar 12 may be conventionally disposed on parallel spaced apart supports (not shown) for suspending the anode within the electrolyte solution. The copper bar 12 also provides a conductor path and accordingly must be in intimate conductive relation with the anode 11. For that purpose, it may be seen that the lead alloy encompasses the copper bar and has a relatively increased thickness (indicated at 13 in FIG. 4) to provide proper support upon the copper bar. A window, or opening 14, is commonly formed along a central portion of the anode adjacent the copper bar mainly for the purpose of reducing weight of the anode. Accordingly, the weight of the anode is supported by a strip of lead alloy which extends upwardly along either side of the anode for engagement with the copper bar 12. These strips are indicated at 16. The overall thickness of the anode is increased to approximately 1 in. where the anode surrounds the copper support bar.

It is preferable to form or cast the anodes in substantially the shape indicated in the drawings in order to conserve the lead alloy and to minimize further finishing work. The copper support bar 12 is initially arranged within the base of the mold prior to introduction of the lead alloy and thus becomes an intimate portion of the cast anode.

Casting Apparatus

The casting apparatus employed in practice of the method of the present invention is of a generally conventional type found in many foundry operations. The casting apparatus does not form a particularly important element of the present invention except to enable practice of the preferred method as described below, with one exception as to specific construction of the ladle. Accordingly, the casting apparatus is only indicated generally in FIGS. 1 and 2 and includes a conventional furnace or melting pot 21, a ladle 22 and a mold 23 forming an internal cavity as indicated at 24 in FIG. 2.

The furnace is of a general type suited for the heating of a lead alloy to molten condition in a temperature range generally 700°–800° F. The capacity of the furnace is selected to greatly exceed the volume of the mold cavity 24 so that the lead alloy may be maintained in a molten condition within the furnace after each pour without an interval being required for reheating. Preferably, the capacity of the furnace is selected so that only about 5% of its content is required to fill the mold cavity. Accordingly, additional lead alloy ingots may be added to the furnace after each pour with the molten alloy in the furnace then being immediately ready to commence pouring a new anode.

The combination of the configuration of the ladle 22 and the orientation for the mold 23 are important to the present invention. The importance of those two elements is summarized immediately below and is described in greater detail below in terms of the preferred process or method.

Initially, the mold 23 is preferably formed by separate mold sections 26 and 27 which divide around the periphery of the mold cavity in order to permit rapid removal of the anode. In addition, the mold is arranged with the cavity 24 in vertical alignment to facilitate a preferred method of filling the mold cavity as described in greater detail below. The mold sections 26 and 27 are also preferably formed to provide a top opening 28 along the entire transverse dimension of the cavity 24 in order to permit simultaneous filling along the length of the anode as is also described in greater detail below.

In conjunction with the features of the mold as described above, the ladle 22 is preferably formed as a cylinder which is closed at each end and has approximately a quadrant of its cylindrical surface removed (at 29) in order to permit filling of the ladle from the furnace.

Figure 5:
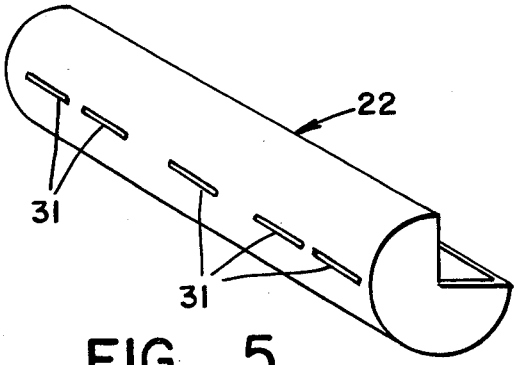
FIG. 5 is a detailed, isometric view of the ladle for the casting apparatus of FIG. 1 to illustrate a preferred configuration therefor.

The ladle 22 includes gating in the form of perforations or apertures 31 extending completely along the transverse length of the cylindrical ladle, the length of the ladle generally conforming with the length of the mold cavity 24. The angular location of the gating upon the cylindrical ladle is selected so that, with the ladle in the position illustrated in FIG. 1, the ladle may be filled with molten alloy from the furnace. The cylindrical ladle is then rapidly rotated to bring the gating apertures 31 into alignment with the opening 28, the molten lead alloy from the ladle streaming downwardly to simultaneously fill all portions of the mold along its length. As may be seen in FIGS. 5 and 6, the apertures are configured or arranged to permit increased flow into selected portions of the mold. Referring again to FIG. 3, it may be seen that the copper bar 12 is initially disposed in a base portion of the mold cavity 24 so that the anode is actually formed in inverse or upside down relation within the mold. Relatively larger amounts of lead alloy are then required adjacent the ends of the mold cavity 24 to initially fill the enlarged portions 13 of the mold cavity which form the sections surrounding the copper bar 12. The window 14 formed along the central portion of the anode further minimizes the amount of lead alloy required along the center of the mold cavity. Accordingly, the gating apertures 31 may be of a larger size adjacent the ends of the mold cavity as is illustrated in the embodiment of FIG. 5. Alternatively, the gating may include a larger number of openings or slots 31' of longer length may be provided adjacent the longitudinal ends of the mold cavity as illustrated in the embodiment of FIG. 6.

Figure 2:
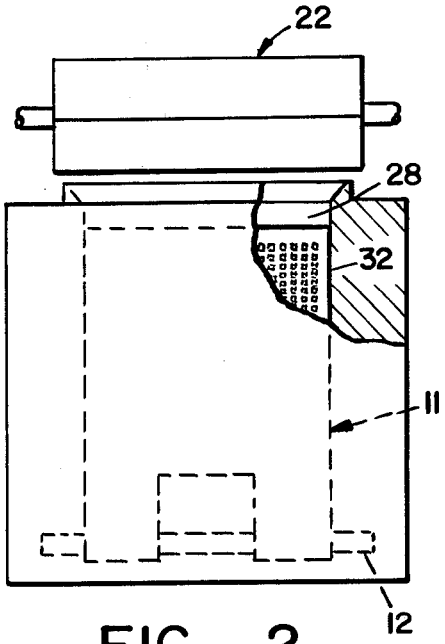
FIG. 2 is an additional view taken from the right side of FIG. 1, to particularly illustrate the configuration and arrangement of an internal cavity within the mold.
Figure 6:
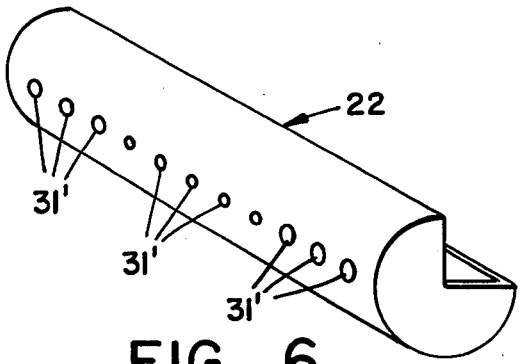
FIG. 6 illustrates another preferred configuration of the ladle.

The ladle of FIG. 6 is employed for filling a mold cavity having no structure to impede or interfere with the streaming of molten alloy toward the bottom of the cavity. Such a mold configuration is employed to form an insoluble anode of continuous cross-sections. The ladle of FIG. 5 is employed to fill a mold configured to form a perforated anode. For this purpose, one of the mold sections may be formed with a large number of lugs arranged in vertical rows. The lugs, as indicated at 32 in FIG. 2, are arranged substantially across the effective area and extend outwardly to about with the other mold section. The gating apertures in the ladle of FIG. 5 are disposed along its length to conform with the spaces between the lugs. Thus, molten alloy may pass in continuous streams toward the bottom of the mold cavity in accordance with a basic object of the present invention.

Both of these embodiments have the purpose of enabling the mold cavity to be completely and uniformly filled with the lead alloy entering into close intimate contact with all surface portions of the cavity while requiring minimum flow of the molten lead alloy. This feature of the invention is initially believed to contribute importantly to maximum density for the anode. In addition, the minimization of molten flow within the mold cavity permits the anode to be solidified more rapidly, an additional important objective of the method of the present invention as described below.

With the arrangement described above, it is possible that lead exiting through the apertures 31 of the ladle may initially tend to contact a lateral surface of the mold cavity during rotation of the ladle to place the gating in register with the mold cavity. Even this amount of contact between the molten alloy and the cavity surfaces could be minimized or substantially eliminated, for example, by the arrangement of a stationary gating member directly beneath the ladle. Through the use of such an element, molten lead alloy from the ladle would tend to be prevented from passing through the gating of the ladle into the mold cavity until the gating apertures 31 are directly above the mold cavity.

The casting apparatus necessary for the method of the present invention may include certain supplemental components, particularly such as temperature sensors, in order to facilitate proper control of the casting process. However, such sensors are believed to be sufficiently conventional within the casting art that they need not be illustrated herein. In addition, the present invention particularly contemplates means for selectively cooling the mold sections 21 and 22. This cooling means, which is also not illustrated, could comprise conduit means integrally formed within the mold sections or could merely comprise separate means such as a nozzle arrangement for spraying a fluid or liquid upon the surfaces of the mold.

Method of Casting

Novelty of the present invention is believed to primarily reside within the method of casting as described immediately below. The use of various alloy agents has long been recognized as providing a means for achieving desired characteristics in resultant castings. In particular, it has long been recognized that lead alloys, especially those including calcium as an alloying agent, are capable of contributing substantially to desired chemical and physical characteristics. Accordingly, the present invention is believed to be of substantial importance since it provides a method of casting which is believed to approach maximum utilization of the performance capabilities for alloying agents such as calcium.

As was indicated above, the casting method of the present invention includes a number of important elements. Initially, it has been found important to regulate temperature or temperature differential throughout much of the casting process. In addition, and/or simultaneously, another important feature has been the minimization of necessary molten flow within the mold before solidification. Additional important elements of the present process include the preferred exclusion of oxygen from the alloy while it is in a molten state and the selection of the alloy material, particularly the selection of lead alloys with calcium as an alloying agent. However, it is once again stressed that the method of the present invention is not limited to lead alloys necessarily including calcium as an alloying agent. Further, it is possible that the casting method of the present invention may be applied to other nonferrous metals as well as lead.

In describing the various elements of the present casting method, it is noted that the selection of alloy composition is discussed above and will be illustrated in even greater detail within the specific examples set forth below. The various specific steps within the casting method or process are described in sequential order below.

Initially, a selected alloy composition is introduced into the furnace and heated to a molten condition. As indicated above, a substantial excess of molten alloy is preferably maintained within the furnace in order to facilitate continuous casting. For example, where each insoluble anode may weigh, for example, in the range of 150 lbs., the total amount of molten lead alloy within the furnace is maintained at approximately twenty times that amount. Accordingly, the total amount of molten lead alloy within the furnace may approximate 3000 lbs. Thus, approximately 150 lbs. of lead alloy, for example, in the form of ingots, may be added to the furnace after each anode is poured. The figures set forth immediately above are primarily for purposes of example and illustrate the proportions necessary to permit generally continuous casting.

The temperature of molten lead alloy is also closely controlled within the furnace. Although optimum values may be established for temperature of the molten alloy within the furnace, those values tend to vary depending upon various external factors such as ambient temperature, humidity, etc. Accordingly, it is to be understood that the discussion of temperature limits for the present casting method establish approximate values or ranges. It is to be further understood that these approximate values or ranges may be varied within the scope of the present invention depending upon factors such as those set forth above and upon additional factors such as selection of the particular alloy composition, size of the anode or casting, etc.

The molten lead alloy within the furnace is maintained at a minimum of about 50° F above its melting point in order to assist in minimizing the time during which the alloy remains molten within the mold. The various types of alloy composition considered at this time exhibit a range of melting points within the approximate range of 500°-625° F. The temperature of the molten lead alloy within the furnace is more particularly maintained at a temperature differential of approximately 50°-100° F above the melting point. For the lead alloys under exemplary consideration, the temperature within the furnace may thus vary from approximately 550° F to approximately 725° F.

As was also indicated above, it is desirable to prevent or minimize oxidation of the molten alloy. The excess quantity of alloy maintained in a molten state within the furnace assists towards this end since the exposed surface area for the molten lead alloy within the furnace necessarily becomes of lesser significance. In addition, it has been found that oxygen contact with the surface of the molten lead alloy may be further limited by floating charcoal upon the surface of the molten alloy or by maintaining a blanket of a relatively heavy, inert gas such as argon above the molten lead alloy within the furnace. It is also noted that such steps are believed to further minimize the loss of calcium from lead alloys where calcium is an alloying agent.

It has further been found that, when calcium is employed as an alloying agent in combination with lead, the calcium content can be further stabilized by impressing an electrical potential across the molten alloy in the furnace. For example, a relatively low direct current voltage of approximately 6V may be applied across the molten alloy by creating a potential between the furnace and a separate electrode (not shown) which is floated on the molten alloy.

In order to commence a cycle for forming an anode of the type illustrated in FIG. 3, a suitable amount of molten lead alloy is transferred from the furnace to the cylindrical ladle. The ladle is maintained in the upright position illustrated in FIG. 1 so that the alloy initially remains completely within the ladle.

It is of course desirable to maintain the alloy temperature within the range discussed above and accordingly it may be necessary to initially preheat the ladle so that it does not cause excessive lowering of the temperature for the molten alloy. However, during a continuous casting process where the ladle is rapidly being filled with molten lead alloy which is then poured into the mold, the temperature of the ladle tends to remain stabilized and does not interfere with proper maintainance of the molten alloy temperature.

In order to further prevent excessive contact of oxygen with the molten alloy, it is contemplated that the alloy may preferably be blanketed against contact with the air in the same manner described above for the furnace.

Prior to the step of pouring molten alloy into the mold, the temperature of the mold is established at a selected differential beneath the temperature maintained for the molten alloy within the both furnace and the ladle. For example, it is generally preferred that the initial temperature of the mold be approximately 200°-250° F lower than the molten alloy temperature. Accordingly, it is generally desirable to maintain the mold surfaces within a temperature range of approximately 400°-500° F. Maintainance of the mold temperature is particularly subject to variation depending upon ambient conditions. It has been found through experimentation that an experienced operator can closely ascertain and control the desired temperature of the mold through observation of the alloy when it is in contact with the mold. For example, the optimum temperature differential may be determined by such an experienced operator through observation of the rate of shrinkage, the rate of solidification and the amount of "drag," etc. as the molten alloy commences to solidify within the mold. The term "drag," as used above, refers to the rate of movement for the molten alloy relative to the surfaces of the mold. As is clearly indicated, such movement is preferably limited by the present invention.

The mold is also arranged in the vertical position illustrated in FIG. 1 with the mold sections being closed together to form the mold cavity which is open along its top. The ladle is then rapidly rotated so that the perforations are placed in register or vertical alignment with the mold cavity. The molten alloy is then permitted to "stream" into the mold cavity and to incrementally fill the mold with limited movement of the molten alloy. A time period of approximately 20-30 sec. may be required for filling of the mold for an insoluble anode. During that time, the molten alloy commences solidification because of the temperature differential for the mole surfaces. Under certain conditions, it may be necessary to further cool the outside of the mold even during the pouring stage, for example, when the ambient temperature is relatively high. Once the mold is filled with molten alloy, it is allowed to remain within the mold for approximately 1-2 min. As soon as the molten alloy is sufficiently solidified within the mold to permit it to become mechanically self-supporting, the mold is opened up by separation of the mold sections 21 and 22.

Before proceeding to describe treatment of the anode after its removal from the mold, it is noted that further cooling of the mold may be necessary during the time period that the molten alloy is solidifying following the pouring step. Cooling of the mold may preferably be accomplished by merely spraying its external surfaces with a mixture of air and water.

It may also be desirable to further limit contact of the alloy with oxygen during filling of the mold. Accordingly, it is also contemplated that the heated mold may be initially filled with a heavy, inert gas such as argon. As the molten alloy is then poured into the mold cavity, the argon is displaced from the mold and in no way interferes with the casting operation.

When the anode is removed from the mold, it is still at a relatively high temperature, possibly in the range of 500° F. It has been found that the configuration of the anode is relatively important from this time until the anode temperature is at a relatively low temperature, possibly 200° F, at which temperature the anode tends to become stable. The anode tends to exhibit a "dimensional memory" whereby upon being freely suspended, it will tend to return to the shape in which it was configured during the final stages of cooling of such a lower temperature. Accordingly, the anode is preferably maintained in a straight configuration and further cooled, for example, by spraying with an air-water mixture until it reaches the low temperature noted above. Alternatively and preferably, the anode is suspended in a vertical position during this cooling step after its removal from the mold. For example, the anode may be readily suspended by the copper hangar bar during this step. With the anode being suspended in a vertical position, substantially no dimensional stresses are developed in the anode. Thus, after it is cooled, it tends to maintain its straight alignment or shape. This of course is important within the electrowinning bath to maintain a uniform gap between the anodes and cathodes and thereby enhance electrolytic action within the process.

It may be noted that, within the preceding method description, substantial importance is placed upon maintaining temperature limits during certain stages of the anode formation. It is believed apparent that these temperature controls are primarily directed toward achieving complete filling of the mold cavity while limiting the amount of time within which the lead alloy remains molten after it enters the mold. After the anode solidifies and is removed from the mold, rapid cooling of the anode is important both for the purpose of limiting further grain change as well as to enhance dimensional stability as described immediately above.

SPECIFIC EXAMPLES

The following specific examples are intended to set forth exemplary limits for various alloy compositions together with the corresponding process parameters under which each of the alloy composition is formed into an insoluble anode.

Example No. 1

An anode of the size described above and having a configuration as illustrated in FIG. 3 (wihout perforations) was formed according to the preceding method description using a ladle with a gating arrangement illustrated in FIG. 5.

The lead alloy was selected as representative of a binary alloy including 0.01–0.1% by wgt, calcium, being obtained in alloyed form as ingots containing 0.04–0.06 wgt. percent calcium, the remainder essentially lead except for normal impurities of the type and amount specified above.

This specific alloy, having a melting point of approximately 621.5° F and a theoretical density of 11.34 grams/cc, is a commercial lead alloy obtained from St. Joe Minerals Corporation.

The alloy was heated in a gas-fired open furnace to a temperature range of 675°–700° F and maintained at that approximate temperature during a relatively short dwell time (up to approximately 30 seconds) in the ladle. The ladle was not heated between pouring cycles but was maintained at a high temperature because of the short time duration (approximately 2½–3 minutes) for each cycle.

The mold, formed of steel, was maintained at a preheated or precooled temperature of approximately 400° F prior to pouring of the molten alloy. No release agent or other coating material was employed in the mold cavity.

The mold was filled, over a time period of approximately 20–30 seconds, according to the method described above. The mold was then allowed to stand for approximately one minute while being sprayed with a water-air mixture to maintain its relatively low temperature (at least at its outer surfaces).

The mold was then opened and the anode removed. The bottom of the anode, which was arranged adjacent the opening 28 of the mold (see FIG. 2) may then be trimmed if desired. However, as soon thereafter as practicable, the anode was suspended in vertical alignment by the copper hangar bar and sprayed for approximately one-half minute on each side with and air-water mixture or until its temperature was lowered to the approximate range of 200°–250° F.

Figure 7:
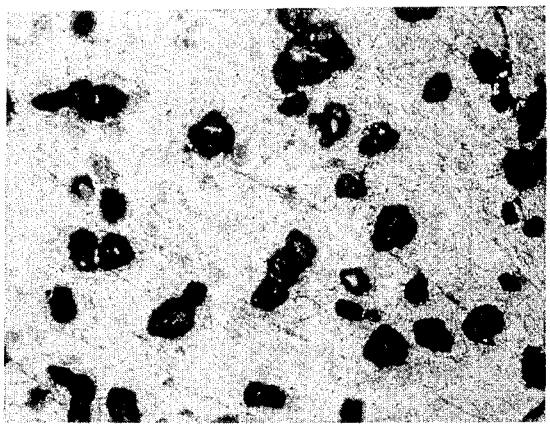
FIGS. 7 and 8 are photomicrographs, at different degrees of magnification, of a typical insoluble anode produced from a lead alloy including calcium as an alloying agent.
Figure 8:
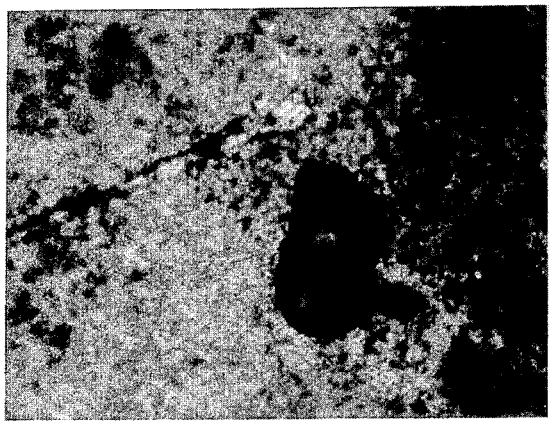
Figure 9:
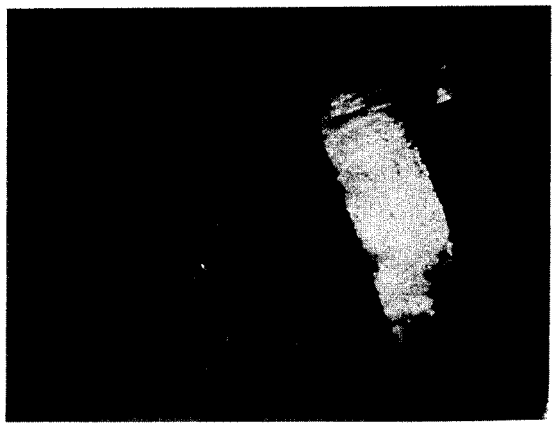
FIG. 9 illustrates the surface finish of a lead alloy anode produced by the method of the present invention.

The anode then exhibited a precipitate distribution and grain structure as illustrated in FIGS. 7 and 8 with the anode surface having a "galvanized" or "rolled" appearance as illustrated in FIG. 9.

The anode surface was not treated or conditioned, beyond the steps described immediately above, prior to preparation of the photograph in FIG. 9.

The anode was also not etched prior to the photomicrographs of FIGS. 7 and 8, at 200 × and 800 × magnification respectively. However, to better illustrate both grain structure and precipitate distribution, the anode surface was polished with a commercial diamond powder. It is believed that the polishing powder picked up fine calcium particles from the precipitates which in turn caused very fine scratches on the anode surface. Such a scratch is particularly noted commencing midway along the left side of FIG. 8 and extending upwardly and rightwardly to approximately the center of the photomicrograph. Such scratches are not to be confused with observable grain boundaries which are present to only a minimum degree in anodes prepared by the method of the present invention. An observable grain boundary may be detected in the highly magnified surface of FIG. 8, noting the short and fine dark line in the upper right corner.

The finished anode was found to have an average density of 11.214 grams/cc and a calcium content of 0.028% by wgt. calcium.

The grain structure and precipitate distribution illustrated by FIGS. 7 and 8 and the surface finish illustrated by FIG. 9, although specific to the binary anode described immediately above, are believed applicable to a wide range of lead alloy compositions, particularly those including calcium as an alloying agent in the approximate range of 0.01–0.1% by wgt.

Example No. 2

This example relates to an anode and method of preparation differing from the limits of Example No. 1 as indicated below.

The alloy for Example No. 2 was selected to include approximately 8 percent by weight of antimony, the remainder essentially lead except for normal impurities such as (in terms of percent by weight) silver—0.0004%, copper—0.0009%, zinc—0.0005%, arsenic—0.0003%, iron—0.0002% and bismuth—0.0014%.

The above alloy has a melting point of approximately 520° F and a theoretical density of 10.74 grams/cc. Such an alloy is heated to an approximate molten temperature of 600° F according to the present invention and thereafter processed as described above for Example No. 1.

The anode produced according to this Example No. 2 would exhibit many of the advantages set forth above. However, it was indicated above that certain characteristics are particularly due to the inclusion of calcium as an alloying agent. Accordingly, even though the anode produced according to Example No. 2 does not prove to have equal characteristics as for an anode including calcium, Example No. 2 does illustrate applicability to a broad range of alloys.

Example No. 3

This example relates to an anode prepared according to the preceding method based on an alloy including approximately 1.5% by wgt. silver, 1.0% by wgt. tin, balance essentially lead except for normal impurities.

This alloy has a melting point of approximately 589° F and a theoretical density of approximately 11.26 grams/cc.

Here again, the method of preparation differs from that described above for Example No. 1 only in the following respects.

The alloy is heated to a molten temperature of approximately 650° F and thereafter treated as described above for Example No. 1.

The anode of Example No. 3 is intended to particularly demonstrate applicability of the present method to more complex alloys, such as the ternary composition described above.

I claim:

1. In a method of casting an insoluble anode including the steps of heating a lead alloy to a molten condition and pouring the molten lead alloy into a suitable mold, the improvement comprising the additional steps of arranging the mold in a vertical configuration and providing an opening along the entire length of the mold for introducing molten lead alloy thereinto, selecting the temperature of the molten lead alloy at a predetermined differential above its melting point, maintaining the temperature of the mold at a predetermined temperature substantially below the melting point, and thereafter continuously streaming the molten lead alloy into various distinct portions of the opening; proportionately along substantially its entire length in order to achieve intimate and complete filling of the mold with minimum flow of the molten lead alloy thereby being necessary.

2. The method of claim 1 wherein the molten alloy is continuously streamed into the mold through variable gating with flow into various portions of the mold being proportional to volumetric distribution of the mold cavity.

3. The method of claim 1 further comprising the additional steps of removing the anode from the mold substantially as soon as it is mechanically self-supporting, arranging the anode in an unstressed vertically suspended configuration and then rapidly cooling the anode to freeze its grain structure and develop dimensional stability therein.

4. The method of claim 3 wherein the lead alloy is selected to include calcium as an alloying agent.

5. The method of claim 2 wherein the temperature of the molten lead alloy selected at approximately 50°-100° F above its melting point, the initial temperature of the mold being approximately 200°-300° F lower than the selected temperature of the molten alloy.

6. The method of claim 5 wherein the lead alloy is selected to include calcium as an alloying agent.

7. In a method of forming a lead alloy casting, the steps comprising selecting the lead alloy to include calcium as an alloying agent.

heating the lead alloy to a selected molten temperature, providing a mold with an opening along its entire length, arranging the mold in a vertical configuration and establishing a selected temperature for the mold, thereafter continuously streaming the molten lead alloy into various distinct portions of the opening proportionately along substantially its entire length, and thereafter rapidly cooling the lead alloy casting which it is in a substantially unstressed configuration to freeze its grain structure and develop dimensional stability therein.

8. The method of claim 7 wherein the lead alloy is selected to include approximately 0.01-0.1% by weight calcium.

9. The method of claim 7 wherein the lead alloy casting is removed from the mold substantially as soon as it is mechanically self-supporting and vertically suspending the lead alloy casting during the subsequent rapid cooling.

10. The method of claim 7 wherein the lead alloy is heated to approximately 50°-100° F above its melting point, the mold being maintained at a temperature approximately 200°-300° F below the temperature of the molten lead alloy.

11. The method of claim 10 wherein the lead alloy casting is rapidly cooled to an approximate temperature range of 200°-250° F while being maintained in an unstressed configuration.

12. The method of claim 10 wherein the lead alloy casting is removed from the mold substantially as soon as it is mechanically self-supporting and vertically suspended during the subsequent rapid cooling.

13. In a method of casting an insoluble anode including the steps of heating a lead alloy to a molten condition and introducing the molten alloy into a suitable vertically arranged mold provided with an opening along its entire length the improvement comprising the additional steps of selecting the temperature of the molten lead alloy and the temperature of the mold at least just prior to introduction of the molten alloy into the mold in order to minimize the time for solidification of the molten alloy in the mold, introducing the molten alloy into the mold by continuously and proportionately streaming the molten alloy into various distinct portions of the opening along substantially its entire length in order to reduce flow of the molten alloy necessary to intimately fill the mold and thereby enhance grain structure finish of the anode, thereafter removing the anode from the mold when the anode is mechanically self-supporting, arranging the anode in an unstressed, vertically suspended configuration and rapidly cooling the anode to freeze its grain structure and to develop dimensional stability therein.

14. The method of claim 13 wherein the lead alloy is selected to include calcium as an alloying agent.

15. The method of claim 13 wherein the molten alloy is continuously streamed into the mold through variable gating with flow into various portions of the mold being proportional to volumetric distribution of the mold cavity.

16. The method of claim 15 wherein the lead alloy is selected to include calcium as an alloying agent.

17. The method of claim 16 wherein the balance of the lead alloy is essentially lead except for normal impurities.

18. A lead alloy casting being of generally flat configuration and having a surface area on each side of at least approximately 5 square feet, the lead alloy casting being produced by the steps of selecting the lead alloy to include calcium as an alloying agent, heating the lead alloy to a selected molten temperature providing a mold with an opening along its entire length, arranging the mold in a vertical configuration and controlling its temperature, thereafter continuously streaming the molten lead alloy into various distinct portions of the opening proportionately along substantially its entire length, and thereafter rapidly cooling the lead alloy casting in a substantially unstressed configuration to freeze its grain structure and develop dimensional stability therein.

19. The lead alloy casting of claim 18 characterized by substantially maximum density and minimum porosity, a uniform precipitate distribution of $PbCa_3$ in a lead matrix, the surface of the lead alloy casting being continuous or smooth and further characterized as having a galvanized or rolled appearance.

20. The lead alloy casting of claim 18 wherein the method of production includes the additional step of removing the casting from the mold as soon as it is substantially self-supporting and vertically suspending the casting during the subsequent step of rapid cooling.

21. The lead alloy casting of claim 18 wherein the method of production includes the additional step of selecting the lead alloy to include approximately 0.01–0.1% by weight calcium.

22. The lead alloy casting of claim 21 wherein the weight percentage range for calcium is approximately 0.02–0.07.

23. The lead alloy casting of claim 22 wherein the balance of the lead alloy casting is lead except for normal impurities.

* * * * *